US007121252B2

(12) United States Patent
Johnson

(10) Patent No.: US 7,121,252 B2
(45) Date of Patent: Oct. 17, 2006

(54) DYNAMIC JOURNAL ENGINE

(76) Inventor: Michael Elman Johnson, 212 Airborne Way, Cross, SC (US) 29436

( * ) Notice: Subject to any disclaimer, the term of this patent is extended or adjusted under 35 U.S.C. 154(b) by 0 days.

(21) Appl. No.: 11/363,409

(22) Filed: Feb. 28, 2006

(65) Prior Publication Data

US 2006/0162678 A1 Jul. 27, 2006

Related U.S. Application Data

(63) Continuation-in-part of application No. 10/989,802, filed on Nov. 17, 2004.

(51) Int. Cl.
*F02B 75/32* (2006.01)

(52) U.S. Cl. ..... 123/197.1; 123/197.4

(58) Field of Classification Search ..... 123/197.1, 123/197.4

See application file for complete search history.

(56) References Cited

U.S. PATENT DOCUMENTS 2,265,171 A * 12/1941 Johnson ..... 123/54.3
4,848,282 A * 7/1989 Chaneac ..... 123/55.3
6,691,648 B1 * 2/2004 Beierle ..... 123/197.1

* cited by examiner

*Primary Examiner*—Noah P. Kamen

(57) ABSTRACT

An internal combustion engine that replaces the throw journal of a crankshaft with a set of contours that are dynamic rather than static. The contour is such that three cycles of engine operation are not affected, i.e., exhaust, intake, and compression. The contour deviates only during the power stroke where an increased incidence to the circular is incorporated. This defers from previous attempts by eliminating complex geometries such as epitrochoidal or sinusoidal that by their nature negatively affect the exhaust, intake, and compression strokes of the Otto cycle when compared to the traditional crankshaft. Additionally, the deviation from the circular orbit during the power cycle optimizes to a larger extent the leverage available for peak thermodynamic pressures in the cylinder in the brief optimum time afforded by that pressure.

4 Claims, 7 Drawing Sheets

DYNAMIC JOURNAL ENGINE

This is a CIP of Ser. No. 10/989,802, now abandoned.

BACKGROUND OF THE INVENTION

1. Field of the Invention

The invention is relative to internal combustion engines which are in present use for transportation, manufacturing, electrical power production, agriculture, forestry, lawn maintenance, and compressors in common use for applications including heating and air conditioning, refrigeration, and inflation.

Internal combustion engines currently used are of two basic designs: Otto cycle or Brayton cycle. Piston engines incorporate a sequential division of a 360 or 720 degree circle roughly segmented in four cycles or strokes. Brayton (turbine) engines perform the same cycles but are continuous in those cycles because of a constant pressure design.

The operation of reciprocating internal combustion engines follows this sequence: the intake stroke, comprising roughly one fourth of the rotation, permits the introduction of combustibles, i.e., fuel and air. The compression stroke, covering again roughly one fourth of the rotation, compresses the air, further atomizing the fuel and heating both to the point of ignition in the case of the diesel concept, or to the point readily ignitable by a device for ignition in the gas engine. The power cycle, covering once again roughly one fourth of the total rotation, is the point in time and revolution where mechanical parts are subjected to the thermodynamic force induced by the rapidly expanding gases. The fourth and last stroke, exhaust, is the sequence of the rotation that allows for the escape of burnt fuel vacating the cylinders thereby providing space and time for the intake cycle and subsequent repetition of the other cycles. Finally, in difference to whether the strokes described be of the two or four stroke design, they occur in either a 360 or 720 degree rotation respectively.

The relative efficiency comparison between the two and four stroke is dependant on not only the physical advantages of one compared to the other, but also some subjective concerns that could loosely be tied to efficiency. The four stroke's increased complexity and increased size and weight compared to its power output is detrimental and the requirement of operating on a relatively horizontal plane are somewhat offset by its comparative fuel efficiency, less pollution, and intended use of the engine. Obviously an engine that has a power impulse once every 360 degrees instead of 720 degrees will produce more power. However, due to a number of physical dictums, what would seem to be an apparent potential of doubling the power output is mitigated by several factors. Some of these are: a decrease in the available volume of the cylinder due to intake, exhaust, and transfer ports, an increase of frictional loses due to higher operating temperatures and the loss of some fuel to the exhaust port during the intake cycle. Subjectively, the efficiency of a two stroke is its relative lightness and its ability to operate in positions other than the horizontal.

2. Description of the Related Art

Engines using a crankshaft suffer first and foremost during the power stroke. At the point whereby the burning and rapidly expanding gases deliver their peak pressure the cyclic progression of the piston, articulated rod, and crank journal assembly is such that leverage imparted to the output shaft is relatively small. This is unavoidable due to the extreme rapidity of the detonation (on the order of $3/1000^{th}$ of a second). By the time leverage increases the design dictates that the piston is pulled down the cylinder thus increasing the volume and subsequently reducing available thermodynamic pressure. Man or animal powered devices using the crankshaft principle are extremely efficient largely due to a constant pressure availability. Attempts to mitigate this dictate have thus far been at the cost of a considerable increase in complexity. Ref. classification 123/197.4 documents U.S. Pat. No. -2001/0017122A1 and U.S. Pat. No. -1,349,660. In the case of the first classification myriad rollers and guide pins are fixed to a rod that has to be forked and offset to accommodate the same and still maintain centering on the piston. These rollers and pins follow the contour of a very difficult to manufacture epitrochoidal drum that likely would encounter severe wear problems, sidereal movement, and flexing. In the second classification an elliptical contour to which a thrust pin is drivingly connected to an output shaft would suffer from severe wear as its function necessitates a 180 degree reversal between cycles. It is in fact, relatively simple, but would suffer from severe vibration resulting in a shorter operational life than the journals of a conventional crank shaft. Additionally, a second piston connected to this elliptical contour would require a cylinder or sleeve to reciprocate and a commensurate increase in complexity and lubrication requirements.

SUMMARY OF THE INVENTION

The goal of this invention is two fold: one, to more efficiently convert the translation of the thermodynamic energy incumbent to internal combustion engines to the rotative forces of an output shaft via the reciprocal motion of a piston and, two, to do so in a manner that does not increase the complexity of said device nor reduce the longevity of the same.

This two part goal is accomplished by eliminating the crank shaft of a conventional engine or compressor and replacing it with a contoured surface that is in function the same as a throw journal of a crankshaft and in fact is no more complicated. The contoured plates revolve around the output shaft in an elliptical orbit and not a concentric one as has been attempted in other variations that seek to optimize the peak explosive pressure on the piston face. Rigidity of the device is assured in that the plates are such that they can be easily attached to a spacer that provides clearance for the piston/rod. Sidereal forces on the pusher/follower pin is further reduced by the design's placement of said follower pin directly parallel to the output shaft. The rod and piston are of a single unit type that further reduces vibration, piston slap, and sidereal forces. Previous attempts to effect this same sort of improvement over the simple crank shaft have displayed a remarkable degree of complexity. Albeit, their concept of utilizing mechanical devices that avail themselves at an advantageous point in time to the rapid detonation in a cylinder suffer from the serious drawback of increased complexity incorporating difficult geometries such as sliding ellipses, sinusodial shafts passing through slotted rods, multiple rollers following the path of an epitrochoidal drum, etc. All that is needed is a device to replace the simplistic journal that connects the rod to the piston in a crank shaft engine with a device just as simple. The second goal of my invention is to effect this replacement of the crank journal without increasing the overall complexity of an engine or compressor. A crankshaft is undeniably simple in concept and operation. The throw arm and its journal can be loosely considered two parts. However, closer examination reveals that there are two throw arms, two race shells, and a journal itself for a total of five. My invention incorporates two plates, one spacer, one follower pin, one bearing, and one retention pin for a total of six. However, the pivoting rod of a crankshaft configuration requires a wrist pin adding one part. The result is an equal number of parts.

The design of the orbital path of the contoured plates can be varied in that the angle of incidence relative to the power stroke in relation to the circular contour of the remaining three strokes can be increased or decreased horizontally as described by a line passing through the contour parallel to a line passing through the center of the output shaft. Further, the contoured distance of the orbital path from the center of the output shaft are subject to the requirements of the engine's function, i.e., the desire for high rpm or high torque. Of paramount importance is this deviation of the angle of the contour for the power cycle in that it provides a higher torque than a crankshaft configuration due to (a.) increased leverage and (b.) obtaining a substantial increase in thrust due to the pressure of the expanding gases at the brief time when they are at their highest.

An additional benefit of this design is the elimination of the wrist pin that connects rod to piston in a traditional crankshaft engine. An even more important reduction in parts associated with this improved geometry is that multiple piston engines are able to eliminate the need for a separate contoured set of plates connecting them to the output shaft. Each piston/rod/follower pin can use the same contoured plates that ordinarily would be used by a single piston. Thus a two cylinder engine would be able to reduce total parts by four, a three cylinder by eight, a four cylinder by twelve, etc. Finally, the need for a lubrication gallery machined through the rod of a conventional crankshaft engine for the purpose of lubrication the wrist pin is obviously eliminated.

The relative worth of the Dynamic Journal Engine concept, therefore, is measurable by its relative simplicity of concept and operation and the consequent manufacturing/maintenance costs, and its more efficient conversion of energy in relationship to torque produced in the case of an engine.

BRIEF DESCRIPTION OF THE DRAWINGS

A more detailed explanation will be defined in the preferred embodiment; listed herein is a nonlimitative example of the enclosed drawings and is of a generic nature.

FIG. 1 (*b*) is a section view of the engine at the end of the power cycle and the beginning of the exhaust cycle (BDC) for a four stroke design (top) and a two stroke design (bottom).

FIG. 1 (*c*) is a sectional view of the engine at the end of the exhaust cycle and beginning of the intake cycle (TDC) for a four stroke design (top) and a two stroke design (bottom).

FIG. 1 (*d*) is a sectional view of the engine at the end of the intake cycle and the beginning of the compression cycle (BDC) for a four stroke design (top) and a two stroke design (bottom).

DESCRIPTION OF THE PREFERRED EMBODIMENTS

With reference to the figures, 1 is a depiction of a generic cylinder, piston/rod, bearing, pin, one mirrored image plate with contour, output shaft and crankcase with an improvement on the translation of reciprocating motion to circular motion by incorporating a dynamic journal.

Figure 1:
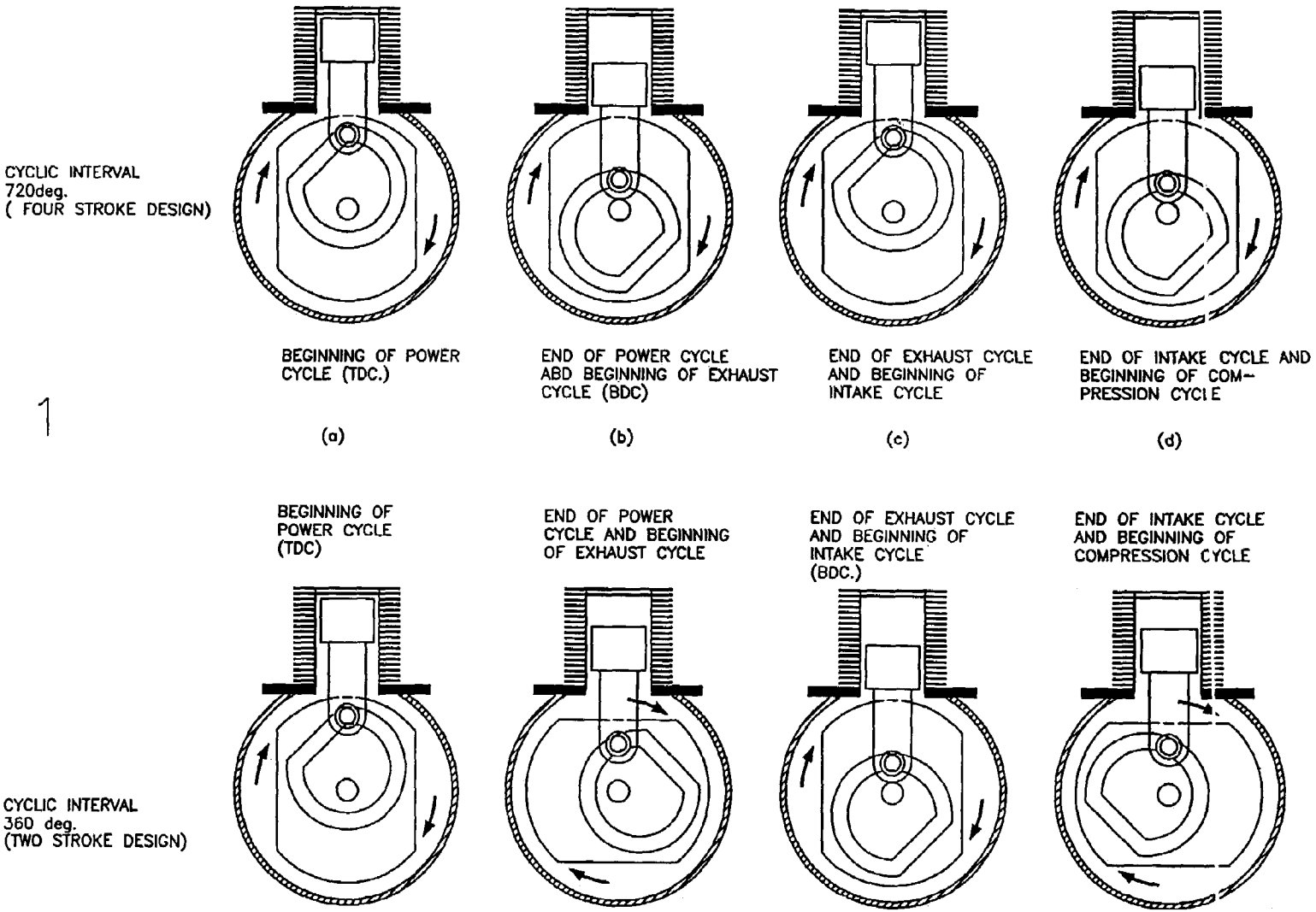
FIG. 1 (*a*) is a sectional view of the engine at the beginning of the power cycle (TDC) for a four stroke design (top) and a two stroke design (bottom).

The cylinder in FIG. 1(*a*) is closed at one end providing a head for the working fluid to expand against the head itself thus translating the moveable piston/rod, bearing, pin in an opposite linear direction.

The pin in the bearing in the rod opposite the piston face is depicted in the contour of the plate in FIG. 1(*a*) at the initiation of the power cycle whereby thermodynamic pressure on the piston crown opposite the cylinder head causes linear motion to be transmitted to said pin which rotates in said bearing creating positive translation of said linear motion to the rotating motion of said contoured plates.

The contoured plate in FIGS. 1(*b*), (*c*), (*d*), imparts inertial force to said pin for the remaining cycles of the Otto cycle.

The contoured plate in FIG. 1(*a*) depicts an increased angle of incidence that allows a rapid increase in leverage advantage during the power cycle when thermodynamic pressure translated through the piston/rod, bearing, and pin are at or near its highest due to the piston's face being in close proximity to the cylinder head.

The contoured plates of FIGS. 1(*b*), (*c*), (*d*) depict the phases of the Otto cycles other than the power phase whereby inertial forces imparted by the now rotating plate and shaft provide force requirements for the sequential cycles exhaust (b), intake (c), and compression (d) by translating said inertial force through said pin, bearing, and rod/piston.

Figure 2:
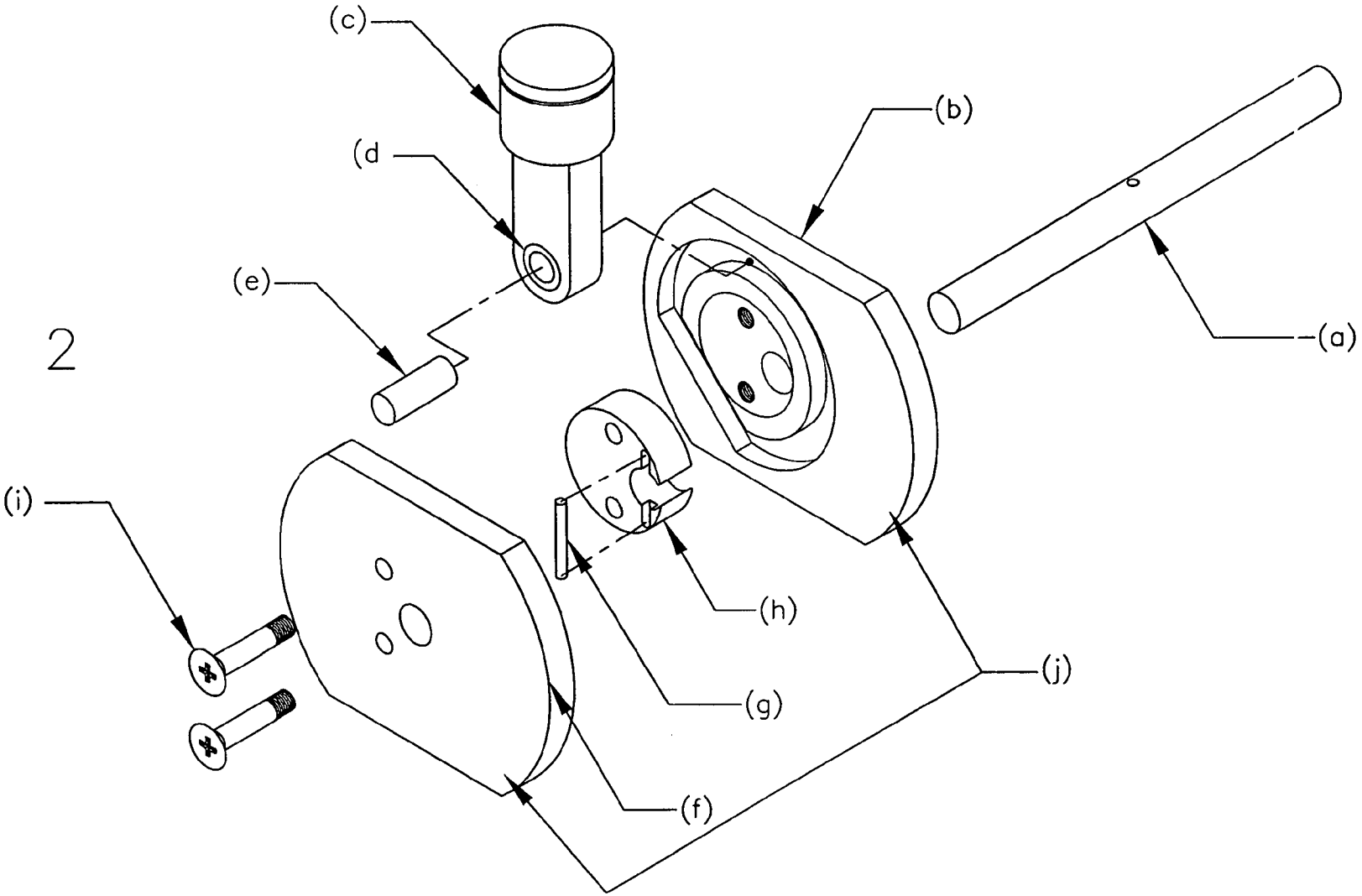
FIG. 2 is an exploded isometric view of the invention illustrating the component parts (a) through (j) of the engine.

FIG. 2 is a depiction of the parts incorporated within the dynamic journal engine.

FIG. 2 part (a) is a depiction of the output shaft whereby rotative motion is translated.

FIG. 2 part (b) and (f) is a depiction of the plates that provide indented contours for the accommodation of the drive pin (e) which is the connecting part that translates rotational movement parts (b) and (f) and reciprocal movement to parts (d) and (c). The indented contours are channels defining a circle portion and a straight portion. The central portion of the circle portion is offset from the shaft axis.

FIG. 2 part (e) is a depiction of a pusher/follower pin that is configured to pass through and extend equally on each side of bearing (d) and rotate in the same.

FIG. 2 (*e*) provides linear thrust to the contours in parts (a) and (f) during the power cycle thereby imparting rotative force to part (a) transmitted through the retaining pin (g) which passes through (a) and (h).

FIG. 2 part (e) transmits the inertial forces of rotational parts to the reciprocal part (c).

FIG. 2 part (c) is a depiction of the piston/rod which is a rigid device that reciprocates in a linear motion in a cylinder enclosed on the end opposite the bearing (d).

FIG. 2 part (h) is a depiction of a spacer that allows clearance for the end of the rod opposite the piston crown to pass between parts (b) and (f).

FIG. 2 part (j) is a depiction of the counterbalance and counterweight area of the contoured plates parts (b) and (f) that dampen vibration and provide additional inertia forces that allow for continuance of rotation for cycles other than the power cycle.

FIG. 2 part (i) is a depiction of fasteners that affix parts (b), (f), (g), and (h) together.

Figure 3:
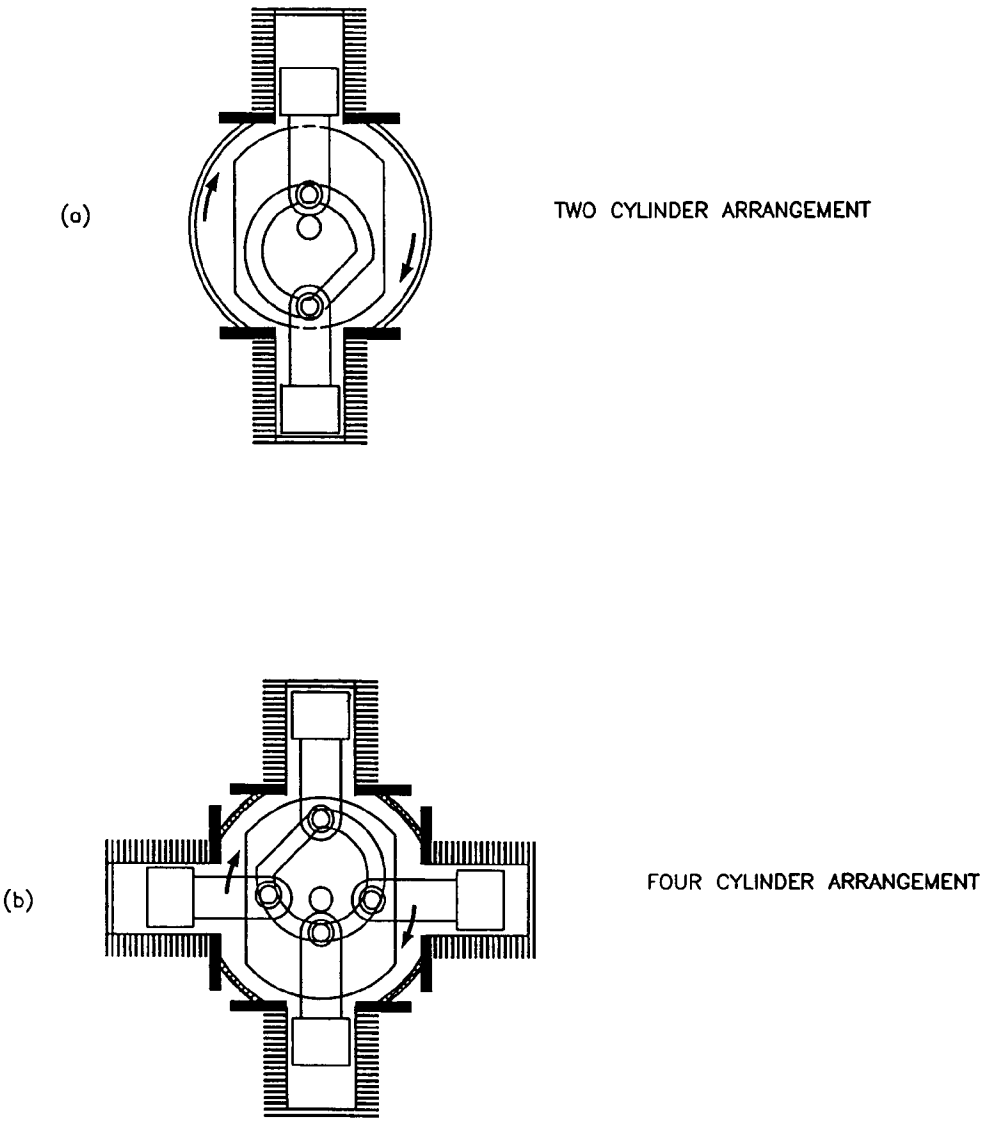
FIG. 3 is a sectional view of a two cylinder arrangement of the engine (a) and a four cylinder arrangement (b).

FIG. 3(*a*) is a depiction of a two cylinder embodiment of the Dynamic Journal Engine illustrating one of two mirror image contoured plates providing the translation of reciprocating to rotating motion via a single set of plates.

FIG. 3(*b*) is a depiction of a four cylinder embodiment of the dynamic journal engine illustrating one of two mirrored image contoured plates providing the translation of reciprocating to rotating motion via a single set of plates. The four cylinders radiate outward.

Figure 4:
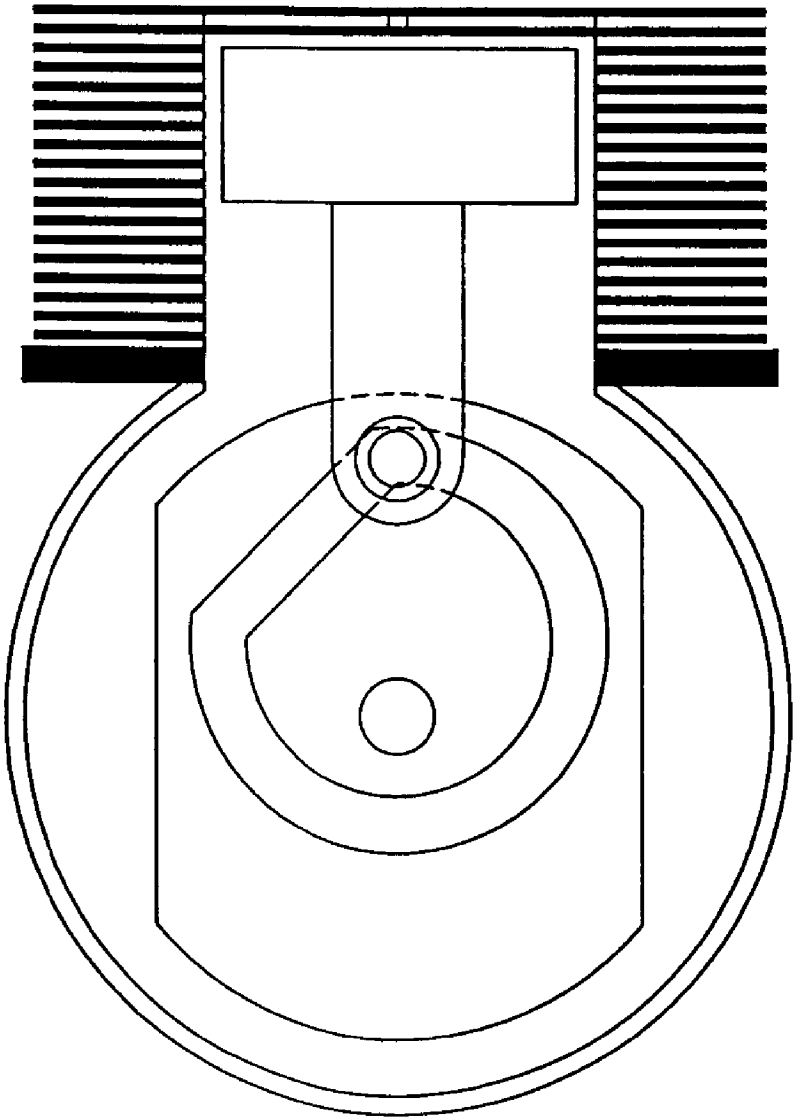
FIG. 4 is a sectional view of the engine with a vastly enlarged cylinder relative to the crankcase.

FIG. 4 is a depiction of an embodiment of the Dynamic Journal Engine illustrating the designs capability of varying size of cylinder displacement without having the limiting factor of rod swing of a conventional crankshaft configuration.

Figure 5:
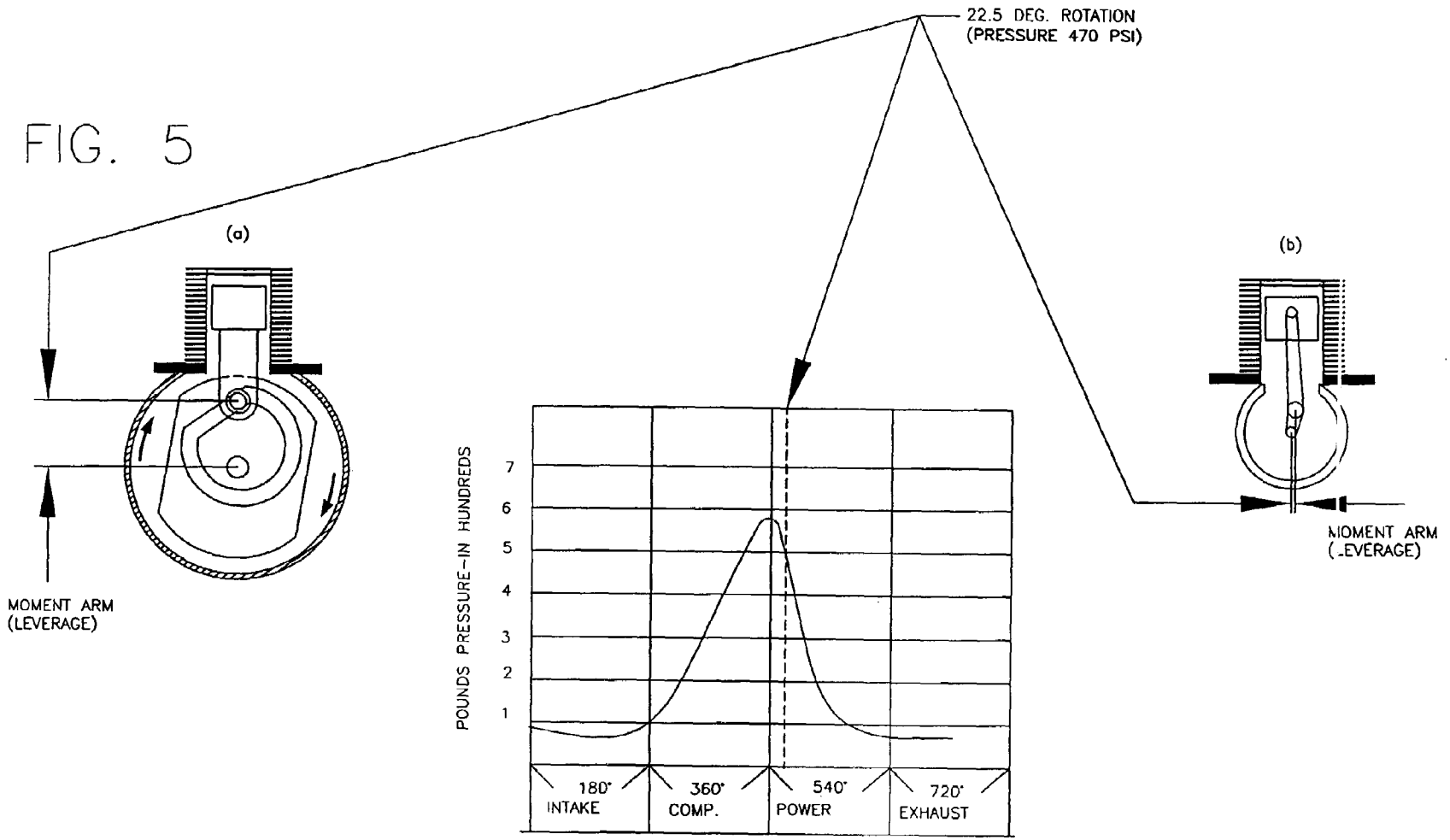
FIG. 5 is a sectional view of the engine (a) and a conventional crankshaft engine with the same displacement (b) with an accompanying graph illustrating a relative moment arm (leverage) comparison.

FIG. 5 is an illustration of the Dynamic Journal Engine (a) and a conventional crankshaft engine (b) depicting a comparison of the relative moment arm leverage available to both designs at a predetermined point of the output shaft rotation (22.5 degrees) and pressure availability between piston face and cylinder head of 470 PSI.

Figure 6:
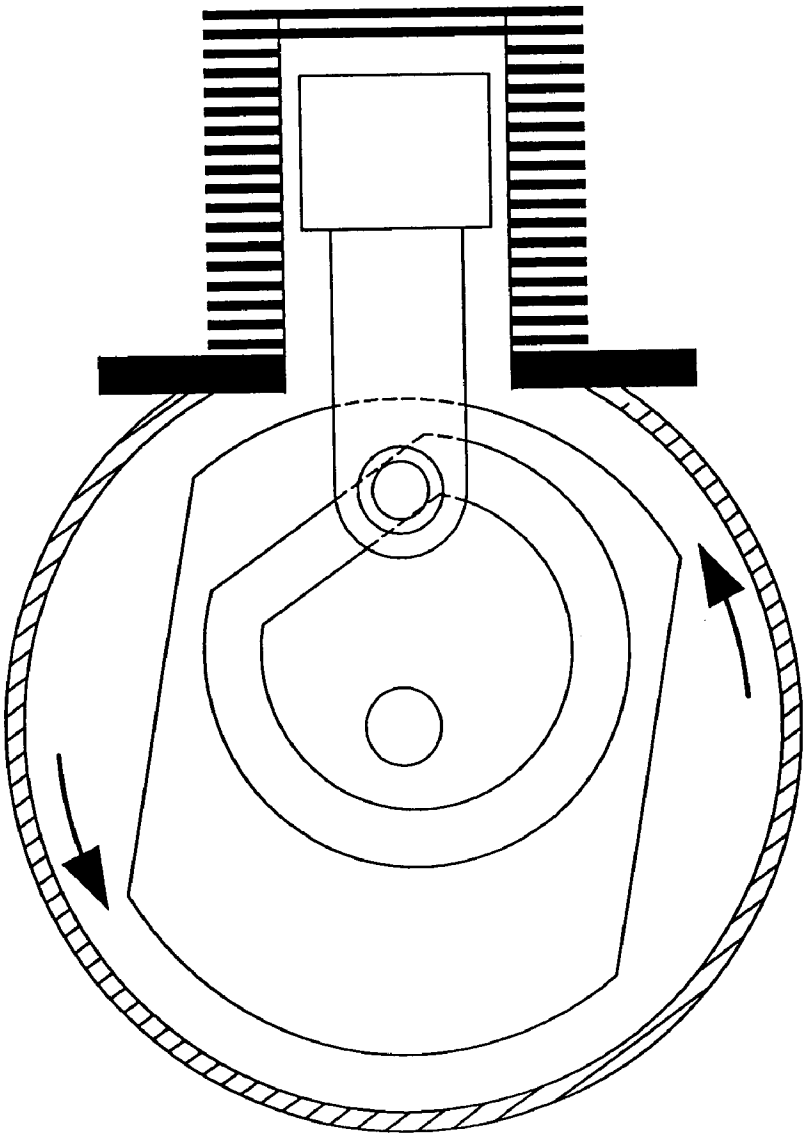
FIG. 6 is a sectional view of the engine with a counter-clockwise rotation.

FIG. 6 is a depiction of a Dynamic Journal Engine incorporating counterclockwise rotation illustrating the same geometric advantage of the power stroke of a clockwise rotation but on the compression cycle.

Figure 7:
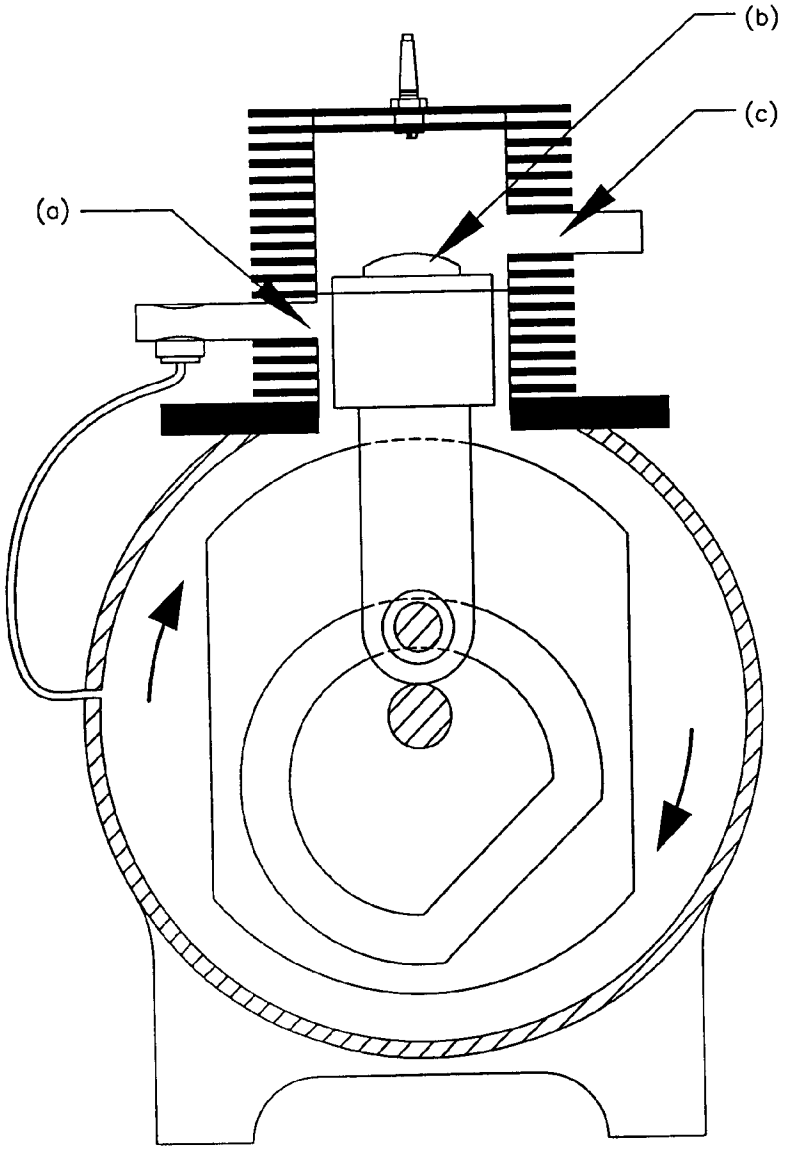
FIG. 7 is a sectional view of the engine illustrating a two stroke design with cylinder ports (a), (b), and (c).

FIG. 7 is a depiction of a Dynamic Journal Engine of the two stroke design at the end of the exhaust cycle at the sequence when intake at the intake port (a) has been effected through the carburetor, exhaust has been effected through the exhaust port (c) and fuel/air transfer is being effected through the transfer port (b).

The engine of the Dynamic Journal Engine is a configuration that utilizes the simplicity of the crankshaft design but radically increases efficiency by a geometry that avails itself to peak leverage on the output shaft at a moment when that peak thermal dynamic pressure is available on the piston face and thus transmitted through a fixed rod, bearing, and pin to a contoured set of plates that replace the throw journal of a crankshaft.

The working fluid supplying the thermodynamic energy may be gasoline, diesel fuel, methane, butane, propane or any other readily combustible fluid.

The dictates of the constant volume design of the Otto cycle using a working fluid necessitates a rapid impulse (translation of power) at a point in time when leverage is at an optimum (dynamic journal geometry) as opposed to a conventional crankshaft when leverage is minimal.

The engine thus conceived is susceptible to many variations, e.g., angularity of the offset contours during different phases of the Otto cycle, length of stroke, cylinder displacement, etc, however, all fall within the basic scope of this invention.

What is claimed is:

1. An internal combustion engine comprising a cylinder and a piston for reciprocating in said cylinder, a rod rigidly connected to said piston at one end and having a rotatable pin in a bearing at the opposite end, two plates each having a channel in which ends of said pin ride, said plates mounted on a rotatable output shaft, said channels defining a circle portion with a straight portion, the central axis of circle portion is offset from the axis of said shaft, wherein the reciprocation of said piston rotates said output shaft as said pin rides in said channels.

2. The internal combustion engine of claim 1, wherein said engine is adapted to operate on the Otto cycle.

3. The internal combustion engine of claim 1, wherein there is a plurality of said radiating cylinders.

4. The internal combustion engine of claim 1, wherein said plates are connected together by a spacer with a retaining pin.

* * * * *